US008860333B2

(12) United States Patent
Garcia

(10) Patent No.: US 8,860,333 B2
(45) Date of Patent: Oct. 14, 2014

(54) METHOD OF INTERFACING WITH A PORTABLE LIGHT

(71) Applicant: Richard Jeff Garcia, Beaumont, CA (US)

(72) Inventor: Richard Jeff Garcia, Beaumont, CA (US)

(73) Assignee: Janlincia LLC, Yucaipa, CA (US)

( * ) Notice: Subject to any disclaimer, the term of this patent is extended or adjusted under 35 U.S.C. 154(b) by 95 days.

(21) Appl. No.: 13/681,978

(22) Filed: Nov. 20, 2012

(65) Prior Publication Data

US 2014/0139141 A1 May 22, 2014

(51) Int. Cl.
*H05B 37/02* (2006.01)

(52) U.S. Cl.
CPC ..... *H05B 37/02* (2013.01)
USPC ..... 315/362; 315/313; 315/307

(58) Field of Classification Search
USPC ..... 315/307, 313, 362
See application file for complete search history.

(56) References Cited

U.S. PATENT DOCUMENTS

| | | | | |
|---|---|---|---|---|
| 8,425,078 | B2 * | 4/2013 | Matthews et al. | 362/206 |
| 2010/0219775 | A1 * | 9/2010 | Maglica et al. | 315/362 |
| 2011/0037419 | A1 * | 2/2011 | Hoffman et al. | 315/313 |

* cited by examiner

*Primary Examiner* — Don Le

(57) ABSTRACT

A method for using a directional switch on a portable light where the switch input is interpreted according to the switch position relative to gravity.

22 Claims, 4 Drawing Sheets

Schematic that shows one embodiment for a flashlight LED circuit

Fig. 1 – Schematic that shows one embodiment of a powered tail cap circuit that implements a directional switch and inertial sensor.
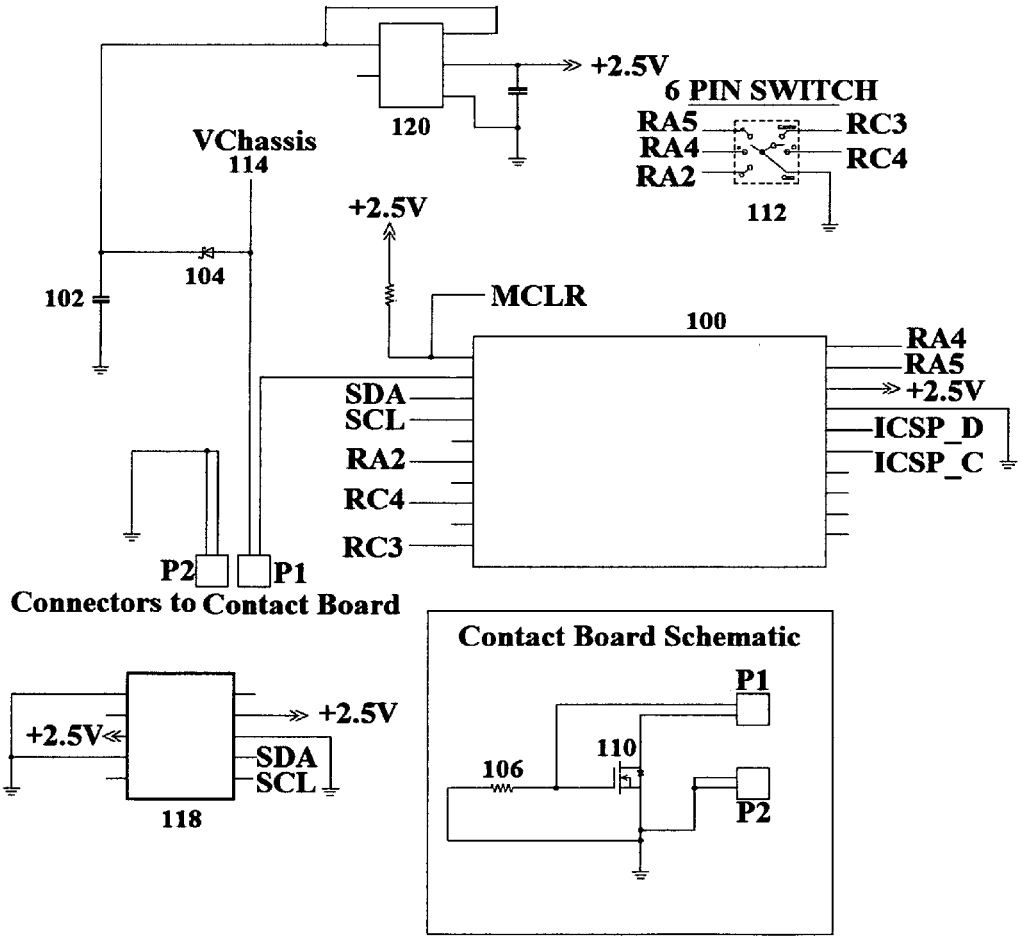

Fig. 2 – Schematic that shows one embodiment for a flashlight driver circuit
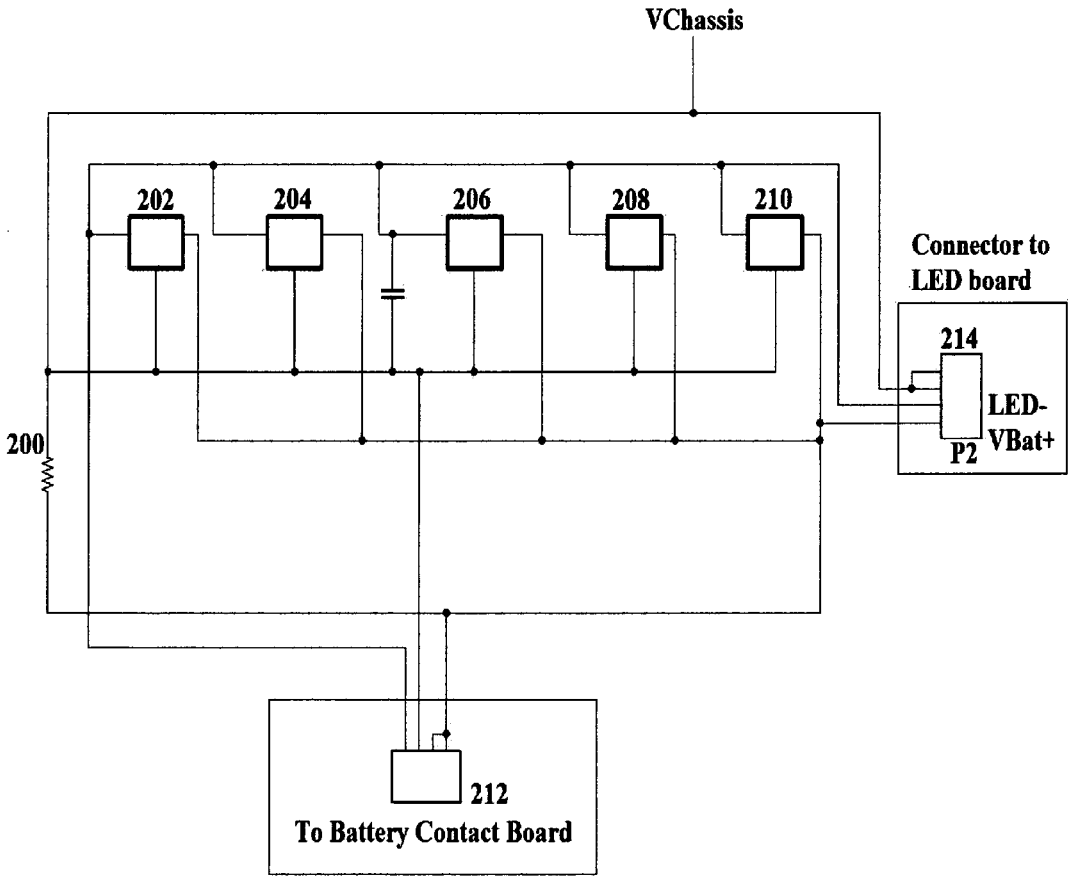

Fig. 3 – Schematic that shows one embodiment for a flashlight battery contact circuit
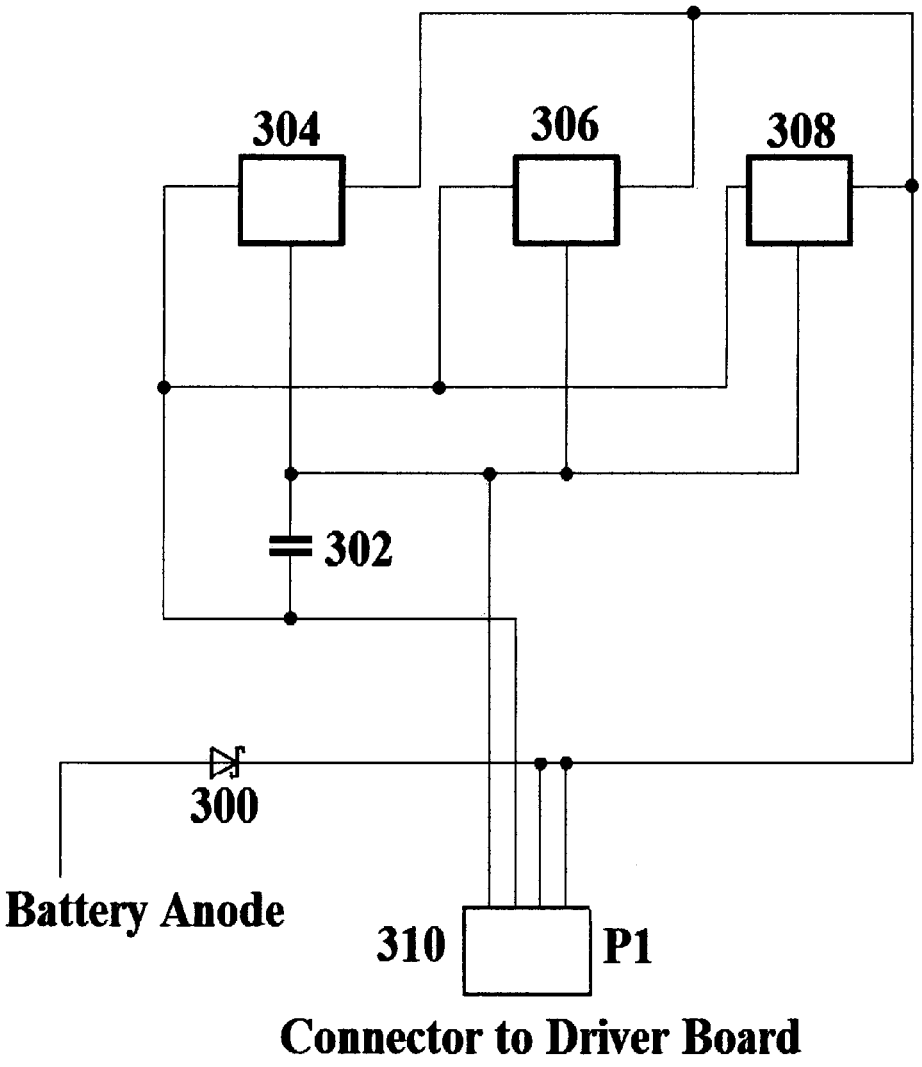

Fig. 4 – Schematic that shows one embodiment for a flashlight LED circuit
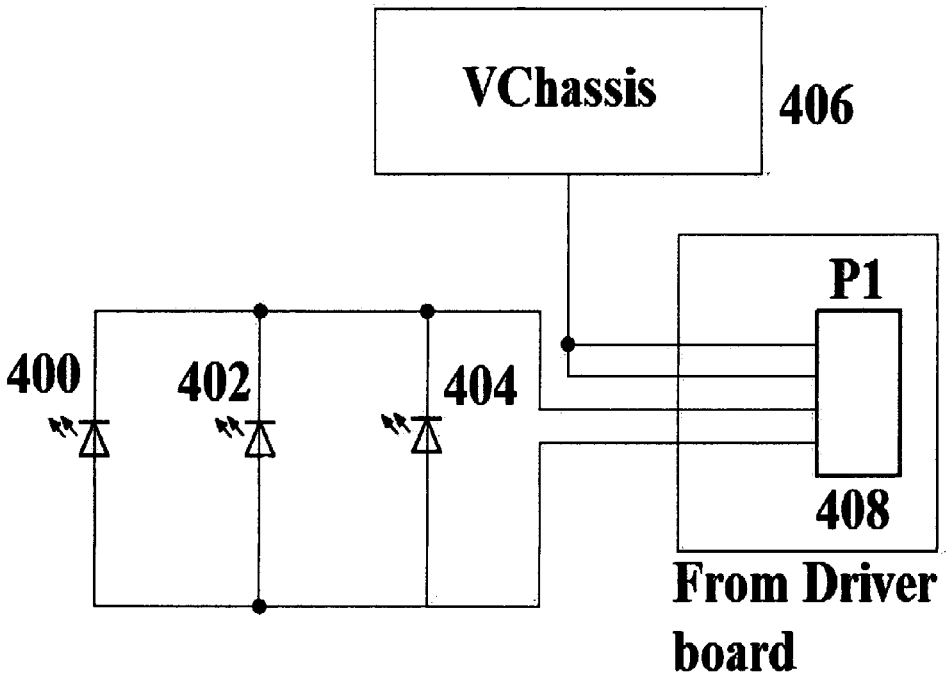

METHOD OF INTERFACING WITH A PORTABLE LIGHT

CROSS REFERENCE TO RELATED APPLICATIONS

This application claims the benefit of provisional patent application No. 61/629,530 filed Nov. 21, 2011 by the present inventors.

FEDERALLY SPONSORED RESEARCH

Not Applicable

SEQUENCE LISTING OR PROGRAM

Not Applicable

BACKGROUND

Prior Art

The following tabulation is some prior art that presently appears relevant:

| US Pat. No. | US Pat. Issue Date | Patentee |
|---|---|---|
| 12/657,290 | Application, not issued | Maglica et al. |
| 12/505,555 | Application, not issued | West et al. |
| 12/502,237 | Application, not issued | West et al. |
| 12/899,618 | Application, not issued | Hoffman et al. |

This application relates to a new style of human interface with portable lights. As LED lights fill more and more roles sometimes additional functionality is required. Consider LED flashlights. Traditionally flashlights have had a simple electrical switch on either the side or the tail of the flashlight. Note that the end of the flashlight that emits light is often called the head and the opposite end is called the tail. A tail cap refers to the cap or lid that screws on the tail end of the flashlight. The tail cap is removable to allow batteries to be inserted. Note that some designs have the head of the flashlight unscrew to insert batteries instead of having the tail be removed.

As flashlights have advanced through the years various user interfaces have been used as noted in the prior art cited above. A brief summary of portable light interfaces is that the simplest of them are just open or closed switches. The improvement on simple open and closed switches was to have multi-mode flashlights, which cycle through several modes in a loop. Other models introduced mechanical means of selecting different modes of operation including different dimming levels by having complicated mechanical switching paths built into the flashlight. Yet other models, such as those noted in the prior art, made use of physical motions and accelerometers to change the operation of the flashlight. One of the challenges for all of these methods is balancing ease of operation against the increased functionality.

For instance, consider the cited prior art that uses motion based methods for interfacing with a portable light. One problem with motion based methods of control is that the motions required for operating these portable lights are not always intuitive. There isn't a natural connection between turning a light clockwise or counterclockwise for more or less light. Some of the prior art requires that the flashlight be held in a certain orientation, which might work well with a skilled user but can really confuse someone who isn't as familiar with that approach.

This invention addresses the user interface as well as opening up new options for programming the portable lights without requiring a cable. The invention is to combine a means of determining orientation, a portable light, and a directional switch or joystick. The problem with a joystick for portable lights has been that determining the orientation of the joystick relative to the portable light was not intuitive and user friendly. It required the portable light to be held in a certain orientation. For example Mag Instruments in Ontario, CA released a flashlight that requires the user to hold it in a certain orientation and click a button to change modes. This is not user friendly due to the requirement that the flashlight be held in a predetermined orientation. Moreover, when one is in the dark determining the orientation quickly is a challenge in its own right. The new invention uses an accelerometer as a means to reference the portable light's orientation to gravity, not as a means to detect predefined motions as the cited prior art does. Thus "Down" means toward the center of the Earth, or towards gravity, and "Up" means away from the center of the Earth. With this gravity based reference point, the user is able to use the joystick in a much more intuitive manner. What orientation they hold the flashlight in no longer matters, which is a key advantage. "Up" will always be what people think of as "Up" and "Down" will always be towards the Earth's center, or what people would call "Down" or towards the ground. Since a joystick can be pushed in multiple directions, the old way of linearly going through all of the modes by clicking the flashlight on and off no longer has to be used. Modes can now be changed by pushing the joystick "Right" or "Left". This also enables a new concept for portable lights—the ability to move through the various light modes both forwards and backwards. If you have ever used a portable light that has a lot of modes you will surely appreciate the utility of that. Thus one embodiment would interpret joystick input to mean "Up" makes the light brighter, "Down" makes the light dimmer, and the two sideways directions can be used for moving through a loop of modes in either direction.

The accelerometer can also be used to program the device. By holding the flashlight in a certain orientation and pressing the button between one or more bits can be easily encoded. Alternatively, sound can be used to program the portable device since the accelerometer can detect the motion that the sound waves produce in a device. This obviously works better for bass tones. Either programming method can be assisted by a computer. For example the computer could show the user the correct sequence to hold the flashlight in to program it. Alternatively, the computer could generate the sound sequence needed to program the flashlight.

Another variant of using an accelerometer for programming input is detecting vibration, such as from a cell phone's vibration feature. By simply holding the vibrating device against the portable light vibration sequences could be sent to program or setup the portable light. For network enabled devices such as a cell phone it could be either running a local application or could get the vibration information over a network. The cell phone could emit an encoded series of vibrations that could then be used to program the portable light.

To help illustrate the scale of the problem, here are some of the settings that are commonly available on portable lights:

1. Color selection, either by color mixing or by turning on different LED colors
2. Brightness selection 3. Mode order selection, for example changing from High→Med→Low or Low→Med→High
4. Mode modification (ie speed of light strobe, speed of SOS flashes, and other variations)
5. Multiple custom modes that allow for customizing features such as strobe rate, brightness, order of mods, etc
6. Allowing a portable device to emulate the user interface of a different brand or model of portable light

ADVANTAGES OVER PRIOR ART

One thing is consistent with all of the prior art cited above: they all rely on movement or gestures, which may not always be intuitive. While the methods cited in the prior art are varied, they all take a fundamentally motion based approach to the problem. The method disclosed here also allows for a more familiar button based interface while still retaining the advantages that accelerometers allow such as referencing direction to gravity.

SUMMARY

This invention allows a portable light such as a flashlight to have a directional button, or joystick with a center button, on the tail cap while referencing the joystick to gravity. The advantage is that what orientation the user holds the light in does not matter since it will always reference the joystick to gravity. An additional advantage is that by eliminating the requirement of using motions a more familiar button based user interface can be used.

DRAWINGS

Figures

FIG. 1—Schematic that shows one embodiment of a flashlight tail cap that implements the accelerometer and joystick interface FIG. 2—Schematic that shows one embodiment for a flashlight driver circuit FIG. 3—Schematic that shows one embodiment for a flashlight battery contact circuit FIG. 4—Schematic that shows one embodiment for a flashlight LED circuit

DETAILED DESCRIPTION

FIG. 1

FIG. 1 shows one embodiment of a flashlight tail cap circuit that can implement the method of referencing a joystick with a center button to an accelerometer to measure the position of the joystick relative to gravity described in this patent. The circuit of FIG. 1 is versatile and very easily adapted to a wide variety of operating voltages and current loads. For this embodiment the circuit of FIG. 1 is located in the tail cap of the flashlight. Note that this method of powering the tail cap circuit is described in patent application Ser. No. 13/573,638 filed Sep. 29, 2012. While this method of powering the tail cap is not the focus of this patent it makes for a good example embodiment.

DETAILED DESCRIPTION

FIG. 2

FIG. 2 shows one embodiment of a flashlight driver circuit. In this case the driver circuit was adapted to work with the other circuits shown in FIG. 1, FIG. 3, and FIG. 4 to form one complete working flashlight. For this embodiment the circuit shown in FIG. 2 is located in the head of the flashlight.

DETAILED DESCRIPTION

FIG. 3

FIG. 3 shows one embodiment of a flashlight battery contact board. This board is designed to work with the other circuits shown in FIG. 1, FIG. 2, and FIG. 4 to implement a complete flashlight. For this embodiment the circuit shown in FIG. 3 is located in the head of the flashlight.

DETAILED DESCRIPTION

FIG. 4

FIG. 4 shows one embodiment of an LED board that is designed to work with the other circuits in the figures above to form one complete flashlight. For this embodiment the circuit shown in FIG. 4 is located in the head of the flashlight.

OPERATION

FIGS. 1, 2, 3, and 4

This embodiment includes a circuit and method for powering a flashlight tail cap disclosed in patent application Ser. No. 13/573,638 filed on Sep. 29, 2012. That patent application disclosed a circuit designed to power a flashlight tail cap and, when desired, to also power the constant current circuit in the head of the flashlight. This circuit lends itself well for an example embodiment where an accelerometer is used to reference joystick input to gravity. Note that all of this is accomplished with a single power source, which for this embodiment is a single rechargeable battery with a nominal voltage of 3.7v. First the operation of the embodiment shown in the figures will be described from the moment that the battery is initially installed. After that the light on and light off cases will be described as well as how the accelerometer is used to reference the joystick input to gravity.

When the flashlight embodiment shown in FIGS. 1-4 is first powered up microcontroller 100 will be off. Pull down resistor 106 is at the gate of N-channel MOSFET 110, so MOSFET 110 will be effectively an open circuit. This means that initially the only path for electrical current is through bypass resistor 200, through the body of the flashlight which is indicated as Vchasis in the figures, through diode 104, and finally charging capacitor 102 and circuits in parallel with capacitor 102 such as microcontroller 100. Once capacitor 102 has charged high enough to allow microcontroller 100 to operate, then the flashlight is ready to operate. For this embodiment the flashlight starts in the light off state. In the light off state the tail cap circuit of FIG. 1 is powered but the circuits shown in FIGS. 2-4 will be off, since when MOSFET 110 is not shorted to ground then capacitor 102 will rapidly charge to approximately the same voltage as the battery voltage. I say approximately because some voltage will be dropped across the diodes. Note that in the light off state microcontroller 100 will draw very little current since it can be put in a low power mode, thus not draining much electrical current from the battery. Voltage regulator 120 was also selected to draw very little quiescent current. Since capacitor 102 will be approximately the full battery voltage then there is effectively no voltage left for the circuitry in the head of the flashlight. A very small voltage will be dropped across resistor 200, however since microcontroller 100 draws so little current the voltage drop across resistor 200 is negligible and certainly is not enough to power the LED constant current circuit. Also note that microcontroller 100 is configured to have an internal pull up resistor so that if the center button of switch 112 is pressed microcontroller 100 will be able to detect the pin going low. The microcontroller can also be readily configured to wake up from other inputs from the joystick.

Microcontroller 100 would typically stay in the low power mode until an action happens. For this embodiment the action would be the center button of switch 112 being pressed. When the center button of switch 112 is pressed and the flashlight is in the light off state then microcontroller 100 would wake up from the low power mode and operate the light. Operating the light is accomplished by having microcontroller 100 apply a PWM signal to the gate of MOSFET 110. When the PWM signal is on the high portion of the duty cycle then MOSFET 110 will become a very low resistance path to ground. When MOSFET 110 is acting as a low resistance path to ground then microcontroller 100 can remain powered by capacitor 102. This allows the circuitry in the head of the flashlight, shown in FIGS. 2-4, to have the full voltage of the battery despite the tail cap circuit shown in FIG. 1 being powered. Since capacitor 102 will start discharging while MOSFET 110 is on care must be taken to not have the period be too long nor to have the duty cycle go too close to 100% on. Given that the human eye will detect frequencies that are 100 Hz or above as being a continuous light, as opposed to a rapidly blinking light, the embodiment used a minimum frequency of 100 Hz. For the circuit values shown in FIGS. 1-4 the maximum duty cycle can be as high as 95% while still retaining reasonable design margins for how much capacitor 102 will discharge. Since microcontroller 100 can turn MOSFET 110 on and off very quickly, all of these requirements are easily met.

To control how bright the light is, the duty cycle of the PWN signal applied by microcontroller 100 to the gate of MOSFET 110 can vary the on time or high portion of the PWM signal. This is a standard technique well understood by those skilled in the art. The duty cycle can vary from 0-95% for the embodiment shown in FIGS. 1-4. A higher duty cycle could be achieved by lowering the value of resistor 200. The lower the value of resistor 200 the faster capacitor 102 will charge. The faster capacitor 102 charges the greater the time that MOSFET 110 can be on, thus raising the maximum duty cycle.

In addition to having the flashlight's LEDs be on in a constant method as described previously dimming and patterns can also be implemented. The beauty of this circuit is that it can implement dimming from 0 to 95% and any of the patterns commonly requested by the market such as strobe or SOS modes.

When the light is turned on and the joystick 112 is pressed into one of eight possible orientations, which are up, down, left, right, and the 4 diagonal combinations, then the flashlight reads accelerometer 118 to determine how to interpret switch 112 input. Since accelerometer 118 is part of the same assembly as switch 112, by reading accelerometer 118 and referencing that to ground microcontroller 100 will know how to interpret a given switch of 112 being closed. The direction of ground is able to be determined because there is always 1G of gravitational acceleration in the direction of the center of the planet. When the flashlight is not being moved rapidly, thus introducing other acceleration into the system, determining the direction of ground with a three axis accelerometer can be done. For example, depending on the flashlight's orientation, and thus the orientation of accelerometer 118 and switch 112, a particular switch of 112 being closed will mean different things. Held one way, pin 1 of 112 in FIG. 1 being closed might mean up. Rotate the flashlight a half turn and pin 1 of 112 in FIG. 1 being closed now means down. This is why having the positional information from accelerometer 118 is such key information. Without that the flashlight must be held in a certain way to make use of a directional switch, which is not nearly as easy to use.

OPERATION

Alternate Embodiments

There are several alternate embodiments that are readily apparent. For example, although the embodiment used as an example used a single battery for a power source, the circuit would with almost no modification to the accelerometer or directional switch work with multiple batteries. Although the example embodiment used a total of 5 PCB boards, this number could be readily changed. Another possible implementation is to use a directional analog switch, which is often accomplished with two potentiometers. This would allow for a much finer degree of directional sensing than just the eight positions that this embodiment has. Another possible embodiment would be to use a magnetic switch, which also has a much finer degree of position sensing for the directional switch and is available in multi-axis versions. Ultimately there are quite a few possible directional switch options in addition to these mentioned. However unless a directional switch can be referenced to gravity, then what the user would call "up" or "down" can't be determined. The inertial sensor for this embodiment was a three axis accelerometer, however other inertial sensors exist and are known to the art and could be used instead.

The example embodiment showed the circuit that always had power as being on the high side however it doesn't have to always be that way. Any battery operated device that needs multiple circuits powered, with one or more on the "high side" and one or more on the "low side" could make use of this technique. As mentioned already although this embodiment used a certain method to power the tail cap circuit of FIG. 1 other options are known to the art and could have been used instead.

ADVANTAGES

From the detailed description above a number of advantages over the prior art become evident.

(a) This invention allows the benefits of a directional switch, which is primarily that multiple forms of input can be accepted from a single directional switch. These in turn can be used for multiple functions from a single directional switch, such as navigating through a series of modes in more than one direction or changing the brightness of a portable light up or down.

(b) Since the directional switch, or joystick, is referenced to gravity, the portable light can be held in any orientation, allowing the user to focus on using the light instead of being concerned with how the light is being held. This benefit is especially pronounced on symmetric objects or round objects like a flashlight.

(c) Since the directional switch is referenced to gravity the very structure of language is consistent with how the device is used. For example the notion that to make the light dimmer you press down makes people think related thoughts, such as turning down the light or lowering the light. Along the same lines, up meaning turning the light up or making the light go up is also consistent with how language is used. This allows for easy mnemonics for how the flashlight is used and allows for more intuitive use.

Although the descriptions above contain many specificities, these should not be construed as limiting the scope of the embodiments but as merely providing illustrations of some of several embodiments. For example, I used a LED flashlight as an example embodiment but the same benefits and advantages of this method would apply to other LED lights such as LED headlamps, LED bike lights, etc. Thus the scope of the embodiments should be determined by the appended claims and their legal equivalents rather than by the examples given. I also used the circuitry disclosed in patent application Ser. No. 13/573,638 filed Sep. 29, 2012 for the embodiment described in this application but could have used other methods of powering a flashlight tail cap that are currently known in the prior art.

I claim:

1. A portable light that is comprised of a light source, an inertial sensor for determining the orientation of the portable light, and one or more switches where the switch input is interpreted differently depending on the orientation of the portable light.

2. The portable light of claim 1 that uses the switches to move through a sequence of various modes either forwards or backwards through the same sequence.

3. The portable light of claim 1 where user interface settings can be programmed by sending coded sequences of vibration which would be detected using the inertial sensor.

4. The multi-mode portable electronic lighting device of claim 1, wherein the user interface can be used for mode selection as well as mode adjustment.

5. The multi-mode portable electronic lighting device of claim 1 where the switch is a multi-axis magnetic sensor.

6. The multi-mode portable electronic lighting device of claim 1, wherein the inertial sensor is an accelerometer with one or more axis.

7. The coded sequences of vibration of claim 3 where the vibration sequences are generated by a cell phone vibration motor.

8. A multi-mode portable electronic lighting device, comprising: a light source; a controller controlling the operation of the light source and configured to implement a plurality of modes of operation; an inertial sensor; a user interface for giving input to the controller where said input is interpreted differently depending on the orientation of the portable light.

9. The multi-mode portable electronic lighting device of claim 8, wherein the user interface is a switch that has at least two axis of motion.

10. The multi-mode portable electronic lighting device of claim 8, wherein the user interface is a joystick.

11. The multi-mode portable electronic lighting device of claim 8, wherein the inertial sensor is an accelerometer with one or more axis.

12. The multi-mode portable electronic lighting device of claim 8 where the user interface uses a multi-axis magnetic sensor.

13. The portable light of claim 8 where user interface settings can be programmed by sending coded sequences of vibration which would be detected using the inertial sensor.

14. The coded sequences of vibration of claim 13 where the vibration sequences are generated by a cell phone vibration motor.

15. A method of using an inertial sensor located on the same assembly as a multi-axis switch where the inertial sensor is used to determine the direction of gravity and reference the input from said multi-axis switch relative to gravity.

16. The multi-mode portable electronic lighting device of claim 15 where the switch includes a magnetic sensor.

17. The portable light of claim 15 where user interface settings can be programmed by sending coded sequences of vibration which would be detected using the inertial sensor.

18. The multi-mode portable electronic lighting device of claim 15, wherein the user interface includes one or more potentiometers with one or more axis of motion.

19. The multi-mode portable electronic lighting device of claim 15, wherein the user interface is an analog position sensor with one or more axis of motion.

20. The multi-mode portable electronic lighting device of claim 15, wherein the inertial sensor is an accelerometer with one or more axis.

21. The multi-mode portable electronic lighting device of claim 15, wherein the user interface can be used for mode selection as well as mode adjustment.

22. The coded sequences of vibration of claim 17 where the vibration sequences are generated by a cell phone vibration motor.

* * * * *